US006305545B1

(12) United States Patent
Morrow

(10) Patent No.: US 6,305,545 B1
(45) Date of Patent: Oct. 23, 2001

(54) MOISTURE BARRIER Q PACK SHIPPING BOX

(75) Inventor: Anthony B. Morrow, Palo Alto, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/604,250

(22) Filed: Jun. 27, 2000

(51) Int. Cl.[7] ..... B65D 81/02

(52) U.S. Cl. ..... 206/522; 206/320; 206/524.8; 383/3; 220/273

(58) Field of Search ..... 206/521, 522, 206/523, 305, 320, 576, 591, 592, 594, 524.8; 383/3; 220/723

(56) References Cited

U.S. PATENT DOCUMENTS

| | | | | |
|---|---|---|---|---|
| 3,943,987 | | 3/1976 | Rossi . | |
| 4,013,265 | | 3/1977 | Speidel . | |
| 4,522,623 | | 6/1985 | Laüterjüng . | |
| 5,246,114 | * | 9/1993 | Underwood | 206/524.8 |
| 5,570,780 | * | 11/1996 | Miller | 206/305 |
| 5,944,211 | | 8/1999 | Woodnorth et al. . | |
| 5,989,313 | | 11/1999 | Mize . | |
| 6,073,770 | * | 6/2000 | Park | 206/522 |
| 6,135,253 | * | 10/2000 | Weissman et al. | 190/36 |
| 6,135,277 | * | 10/2000 | Armstrong | 206/314 |
| 6,234,351 | * | 5/2001 | Wilcox | 222/92 |

* cited by examiner

*Primary Examiner*—Paul T. Sewell
*Assistant Examiner*—Jila M. Mohandesi

(57) ABSTRACT

In order to ship items such as IC computer chips and the like type of electronic parts, a shipping container includes a pump which can pump air from the interior of the container into bladder-like air chambers which are disposed along the interior walls of the container and which can be pressurized to form insulating barriers about the container contents to protect them from external shock. Once the lid of the container is closed, the pump, which is formed into part of the container, can be operated to transfer the air from the interior of the container into the bladder-like air chambers which are fluidly interconnected. This reduces the pressure in the container to a sub-atmospheric level and raises the pressure in the air chambers to a level in excess of atmospheric. The internal sub-atmospheric pressure of course holds the lid closed which can be additionally sealed with a suitable adhesive tape/gasket materials. By flushing the interior of the container and/or the bladder-like air chambers, with clean dry air before closure of the container, it is possible to provide the container with its own on-board supply of clean dry air which can be used to relieve the sub-atmospheric pressure via the operation of a relief valve which is incorporated into the pump arrangement.

8 Claims, 1 Drawing Sheet

MOISTURE BARRIER Q PACK SHIPPING BOX

BACKGROUND OF THE INVENTION

1. Field of The Invention

The present invention relates generally to containers for shipping electronics parts such as microchips and the like, from a point of manufacture to a point of assembly into larger, more complex devices such as computers and the like. More specifically, the present invention relates to container arrangement which is provided with its own on-board pump which can partially evacuate the interior of the container and maintain the contents in a suitable sub-atmospheric desiccated condition during transportation to and/or storage.

2. Related Art

Efforts have been made to provide evacuated containers suitable for transport of perishable items. Examples of such containers are found in U.S. Pat. No. 3,943,987 issued on Mar. 16, 1976 in the name of Rossi and U.S. Pat. No. 5,944,211 issued on Aug. 31, 1999 in the name of Woodnorth et al. These arrangements while permitting the interiors to be partially evacuated and to have relief valves via which the negative pressure can be selectively relived, have suffered from the shortcomings that they are not internally padded and nor provided with any means of maintaining a supply of clean dry air on board so that selective pressure relief can be made via the supply of clean dry air. More specifically, the arrangement disclosed in U.S. Pat. No. 3,943,987 is directed to a recloseable or reusable container having an air-tight closure seal and an attached means to allow the creation of a partial vacuum in the container after reclosing thereof with perishable contents inside. This container includes a replaceable closure member capable of forming an airtight seal with a body portion of the container. An evacuation valve is provided on the closure member or another accessible part of the container allowing the partial removal of air trapped therein after closing the container. A separate manually operated valve is also provided to relieve the vacuum to facilitate reopening of the container.

On the other hand, the arrangement disclosed in U.S. Pat. No. 5,944,211 issued on Aug. 31, 1999 in the name of Woodnorth et al., is such as to include a container system having a one-piece, one-way valve. The container can be evacuated by pressing the lid, thereby forcing air out through the one-way valve. The one-way valve prevents air from entering the container system however includes an interface or release which allows air to enter the container system when the interface is pressed.

Neither of these arrangements, however, have been able to meet the needs of the semiconductor industry wherein it is necessary to pack and ship chips and the like type of devices items with a high degree of safety against damage such as tends to occur if the container is dropped any distance onto a hard surface, and the like.

SUMMARY OF THE INVENTION

A manually operable pump is provided which can be used to pump air out of the interior of the container into bladders which are disposed along the interior walls of the container which thus become inflated and serve as shock absorbing barriers which protect the contents of the container from both thermal and physical shock, for example. By flushing the interior of the container with clean dry air at the time of loading the items to be shipped, and by pumping this air into the bladders, it become possible to have an onboard source of such air so that in the event that pressure control is required, clean dry air can be reintroduced into the interior of the containers from the bladders.

Since the bladders have a limited amount of flexibility, as the pumping of air takes place the pressure in the interior of the container lowers as the pressure in the bladders increases. While the bladders will expand to some degree the transfer of air induces an overall negative pressure in the container while forcing the bladders into securing engagement with the contents of the container, thus securing them against movement within the container and cushioning them against external sources of thermal and physical shock.

More specifically, a first aspect of the invention resides in a box for shipping articles comprising: a container into which the articles can be disposed; a plurality of interconnected air chambers in the form of bladders which are disposed on interior wall surfaces of the container; a closure member for hermetically closing an opening which is formed in the container and through which articles are introduced into the interior of the container; and a pump for extracting air from the interior of the housing and for forcing the extracted air into the plurality of interconnected air chambers in a manner which reduces the air pressure in the container and for inducing external air pressure to force the closure member into sealing contact with the container.

This arrangement further comprises an air cushion formed in the closure member which is pneumatically isolated from the plurality of interconnected air chambers. In addition to this, a relief valve which releases air from the interconnected air chambers into the interior of the container upon a pressure differential which is in excess of a predetermined magnitude prevailing between the interior of the container and the ambient atmosphere which surrounds the container, is provided.

The pump includes: a manually deflectable diaphragm which forms part of a variable volume chamber; a first one-way valve which fluidly communicates the interior of the container with the variable volume chamber; and a second one-way valve which fluidly communicates the variable volume chamber with the plurality of interconnected air chambers. The pump and the relief valve can be included in a common structure which is incorporated into the container so that the manually deflectable diaphragm forms part of the external surface of the container.

A further aspect of the invention resided in a method of transporting an article comprising the steps of: hermetically sealing an opening in the container through which an article is introduced into the container; and pumping air from the interior of the container into a plurality of interconnected air chambers which line interior surfaces of the container, thus reducing the air pressure in the interior of the container to sub-atmospheric levels and pressurizing the plurality of interconnected air chambers.

This method further includes the step of releasing air from the pressurized interconnected air chambers into the interior of the container when a pressure differential between the interior of the container and an ambient atmosphere surrounding the container, is excessive. In addition to this, the method can include the step of securing the contents of the container in position via engagement with the interconnected air chambers which expand into engagement therewith as air is pumped from the interior of the container into the interconnected air chambers.

BRIEF DESCRIPTION OF THE DRAWINGS

The various merits and advantages of the present invention will become more clearly appreciated as a description of the preferred embodiments and structures associated therewith, are given with reference to the appended drawings wherein.

DESCRIPTION OF THE PREFERRED EMBODIMENTS

Figure 1:
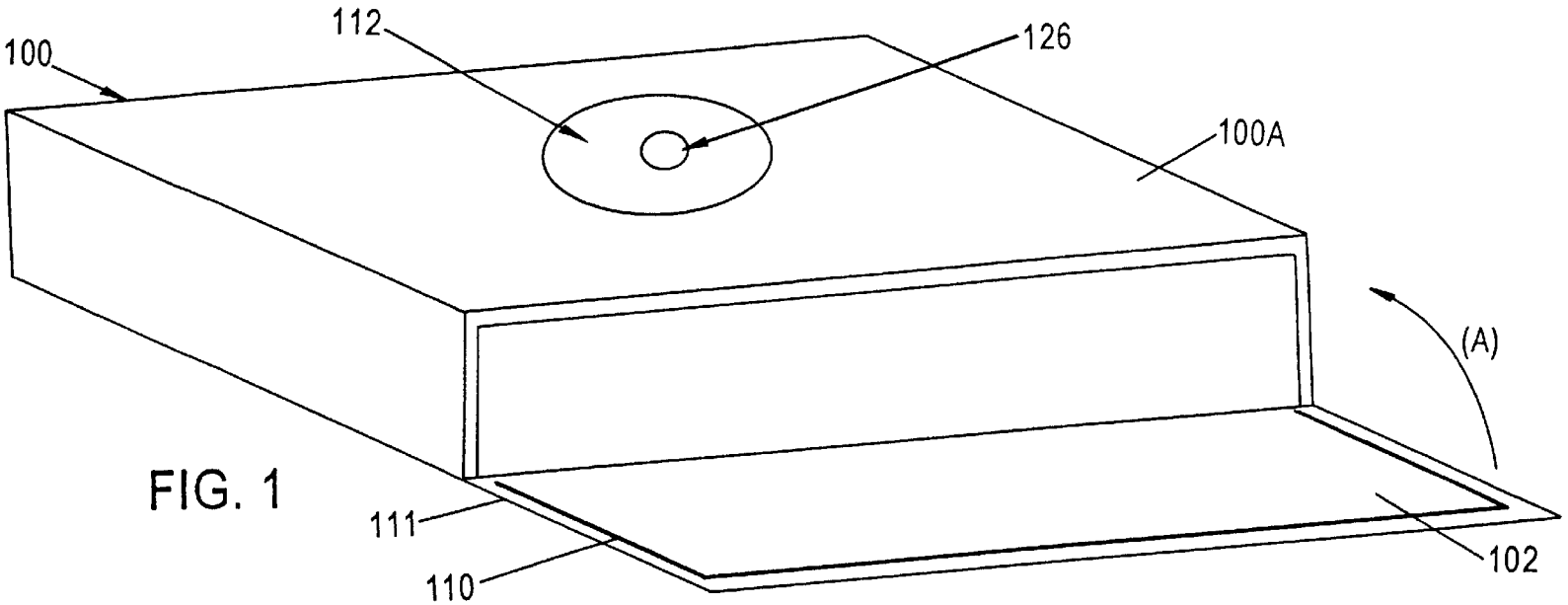
FIG. 1 is a perspective view showing a container/box according to an embodiment of the invention.
Figure 2:
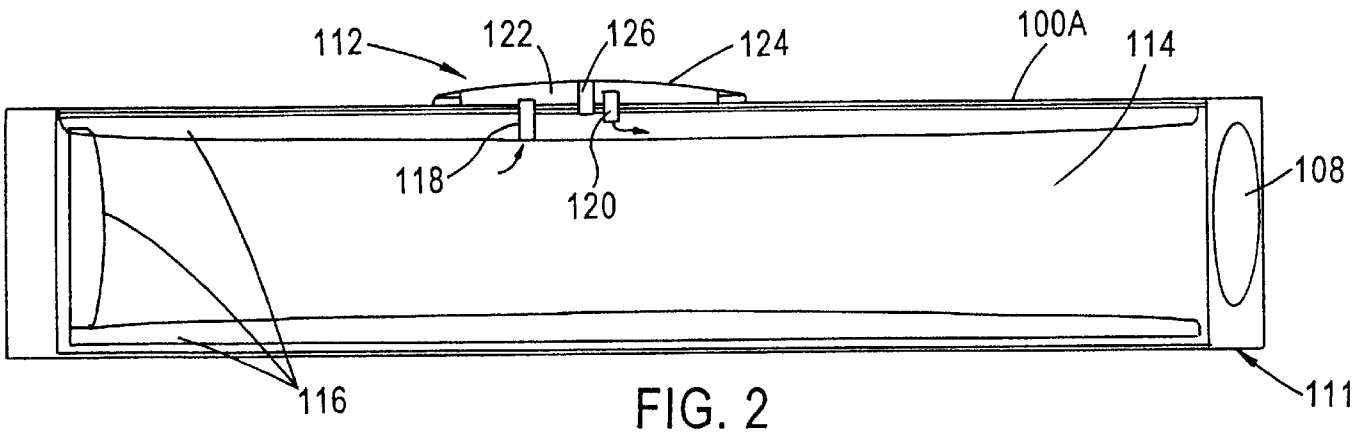
FIG. 2 is a sectional view showing the details of the structure of the container/box shown in FIG. 1.

FIGS. 1 and 2 show an embodiment of the present invention. In this arrangement, a container 100 is provided with a lid member 102. The lid member 102, in this instance is provided with a flexible hinge and is adapted to pivot between an open position and a closed position in the manner indicted by the arrow A. The edges of the lid 102 are provided with interlocking gasket material 104 which assists in producing a hermetic seal when the container 100 is loaded and lid 102 is folded into a closing position. The lid or door 102 of the container 100 is, as shown in FIG. 2, provided with a self-contained pneumatic cushion 108, and is arranged, in this embodiment, with interlocking gaskets 110. In addition to this, a high cohesive tape 111 is provided about the edges to seal the lid closed without the need for the application of heat.

A manually operated pump 112 is provided in an upper deck or surface 100A of the container 100 and is operatively connected between an interior cavity 114 and a series of interconnected air chamber or bladders 116 via first and second one-way valves 118, 120. As shown, the first one-way valve 118 is arranged to interconnect a variable volume chamber 122 of the pump 112 and the interior cavity 114, while the second one-way valve 120 is arranged to interconnect the variable volume chamber 122 and the interior of one of the interconnected air chambers/bladders 116. With this arrangement manual depression of flexible diaphragm member 124, cause the volume of the chamber 122 to be reduced and for air therein to be in part displaced via the second one-way valve 120 into the bladders 116. When released, the diaphragm member 124 is arranged to return to its original configuration under the influence of either its own resiliency or a suitable spring, and thus induct air from the cavity 114 into the chamber 122 Repetitious deflections of the diaphragm 124 pumps air from the cavity 114 into the bladders 116.

As the pressure in the interior cavity 114 reduces, the closure member (viz., the door or lid 102) is forced into snug engagement with the container in a manner which forces the interlocking gaskets 110 into hermetic engagement ensuring a good seal which will resist impact and the like which might be encountered during shipping and handling The chambers or chambers 116 can be formed of aluminized polyfilm for example and to exhibit sufficient resiliency to permit pressurization without expanding to the degree that the pressure reduction in the interior cavity 114 is not excessively inhibited. The expansion of the bladders 116 can also be used to clamp the contents of the container in position and prevent movement during shipping In this embodiment, the separate bladder or pneumatic cushion 108 provided in the door or lid 102 complements the provision of the air bladders 116, and completes the "surround" cushioning of the container contents.

A pressure relief valve 126 is arranged to fluidly interconnect the bladders 116 with the cavity 114 when manually operated such as be depression with a finger or the like. This enables pressure to be restored to the cavity 114 and permit the lid to be opened when so desired. While specific details of the relief valve mechanism are not shown, this can take the form of a valve element which is arranged to normally seal a passage structure which fluidly interconnects the interior cavity 114 of the container with one of the bladders 116. A brief opening of the valve 126 will allow air to transfer from the bladders 116 into the cavity 114. The passage can be made small in cross-section to act as an orifice which throttles the communication to slow the depressurization to a suitable rate and render the control readily manageable.

By flushing the interior cavity 114 of the container and/or the bladders 116, with clean dry air at the time of loading the container with a shipment, the pumping process wherein the clean dry air is pumped out of the interior cavity 114 of the container into the bladders 116, enable the container 100 to be provided with its own on-board source of clean dry air which enables the container to be depressurized confidence that the contents of the container will remain appropriately desiccated and uncontaminated.

Although the invention has been described with reference to only a single embodiment, it will be well within the scope of the person skilled in the art to which this invention pertains to envisage and construct various modifications and variants without departing from the scope of the invention which is limited only by the appended claims. For example, while the disclosed embodiment shows a manual pump 112 and manually operated relief valve 126, it is possible to provide a electrically powered arrangement, and/or provide that the relief valve will respond automatically to an excessively high pressure differential between the interior of the container and the ambient atmosphere to release some air into the interior cavity 114 without operator intervention. The various and sundry changes/modifications will be self-evident when equipped with the preceding disclosure.

What is claimed is:

1. A box for shipping articles comprising:

a container;

a plurality of interconnected air chambers in the form of bladders which are disposed on interior wall surfaces of the container;

a closure member for hermetically closing an opening which is formed in the container and through which articles are introduced into the interior of the container; and a pump for extracting air from the interior of the housing and for forcing the extracted air into the plurality of interconnected air chambers in a manner which reduces the air pressure in the container and for inducing external air pressure to force the closure member into sealing contact with the container.

2. A box as set forth in claim 1, further comprising, an air cushion which is formed in the closure member and which is pneumatically isolated from the plurality of interconnected air chambers.

3. A box as set forth in claim 1, further comprising a relief valve which releases air from the interconnected air chambers into the interior of the container upon a pressure differential which is in excess of a predetermined magnitude prevailing between the interior of the container and the ambient atmosphere which surrounds the container.

4. A box as set forth in claim 1, wherein said pump includes:

a manually deflectable diaphragm which forms part of a variable volume chamber;

a first one-way valve which fluidly communicates the interior of the container with the variable volume chamber; and a second one-way valve which fluidly communicates the variable volume chamber with the plurality of interconnected air chambers.

5. A box as set forth in claim 3, wherein said pump and the relief valve are included in a common structure which is incorporated into the container so that the manually deflectable diaphragm forms part of the external surface of the container.

6. A method of transporting an article comprising the steps of:

hermetically sealing an opening in the container through which an article is introduced into the container; and pumping air from the interior of the container into a plurality of interconnected air chambers which line interior surfaces of the container, thus reducing the air pressure in the interior of the container to a sub-atmospheric level and pressurizing the plurality of interconnected air chambers.

7. A method as set forth in claim 6, further comprising the step of releasing air from the pressurized interconnected air chambers into the interior of the container when a pressure differential between the interior of the container and an ambient atmosphere surrounding the container, is excessive.

8. A method as set forth in claim 6, further comprising the step of securing the contents of the container in position via engagement with the interconnected air chambers which expand into engagement therewith as air is pumped from the interior of the container into the interconnected air chambers.

* * * * *